US006897967B2

(12) United States Patent
Nilsson

(10) Patent No.: US 6,897,967 B2
(45) Date of Patent: May 24, 2005

(54) METHOD OF GRADING RAILROAD BEDS AND A LASER MEASURING DEVICE

(75) Inventor: Dan Nilsson, Skelleftea (SE)

(73) Assignee: Railcare AB, Skelleftea (SE)

( * ) Notice: Subject to any disclaimer, the term of this patent is extended or adjusted under 35 U.S.C. 154(b) by 338 days.

(21) Appl. No.: 10/239,957

(22) PCT Filed: Mar. 28, 2001

(86) PCT No.: PCT/SE01/00669

§ 371 (c)(1),
(2), (4) Date: Sep. 25, 2002

(87) PCT Pub. No.: WO01/75231

PCT Pub. Date: Oct. 11, 2001

(65) Prior Publication Data

US 2003/0090683 A1 May 15, 2003

(30) Foreign Application Priority Data

Mar. 29, 2000 (SE) ..... 0001130

(51) Int. Cl.[7] ..... G01B 11/30
(52) U.S. Cl. ..... 356/601; 37/382; 414/699
(58) Field of Search ..... 356/4.01, 400, 356/601–608; 104/2–17.2; 33/287, 338, 651, 651.1; 405/154.1–184.5; 414/699; 404/84.5; 37/348, 382

(56) References Cited

U.S. PATENT DOCUMENTS

| | | | | |
|---|---|---|---|---|
| 5,301,548 | A | 4/1994 | Theurer | |
| 6,014,815 | A | 1/2000 | Jager | |
| 6,736,216 | B2 * | 5/2004 | Savard et al. | 172/1 |

FOREIGN PATENT DOCUMENTS

| | | |
|---|---|---|
| GB | 2268529 | 1/1994 |
| GB | 2328576 | 2/1999 |

* cited by examiner

*Primary Examiner*—Richard A. Rosenberger
*Assistant Examiner*—Vincent P. Barth
(74) *Attorney, Agent, or Firm*—Mark P. Stone

(57) ABSTRACT

Railroad beds require regrading in order to permit for an increased axial load. There are often cables or tubes embedded in the roadbed at the roadbed sides, making regrading difficult. In accordance with the present invention, material is moved by suction to form pits at each side of the track at intervals along the railroad bed, and a laser camera is used to obtain information relating to the profile adjacent to the pits and the positions of the embedded cables or tubes. This information is saved, and used to control a device for mechanically excavating material from the railroad bed sides without damaging the embedded cables or tubes and grading the railroad bed. A laser measuring device is provided for reading the railroad bed profile.

8 Claims, 4 Drawing Sheets

METHOD OF GRADING RAILROAD BEDS AND A LASER MEASURING DEVICE

TECHNICAL FIELD

This invention relates to a method of grading an existing railroad bed in which cables and/or tubes are embedded outside of the rails. It relates also to a laser-measuring device for reading the profile of a railroad bed.

BACKGROUND OF THE INVENTION AND PRIOR ART

Old railroad beds will often have too much material on each side of the track so that the track will be more or less in a trench, which will obstruct the drainage. The material itself has also often a bad draining capacity. The allowed axle load is often 22 tonnes for old railroad beds whereas an axle load of for example 30 tonnes can be allowed on a perfect railroad bed. Old railroad beds may also allow a higher axle load if their parts outside of the track are regraded (including removal of excess material). If new macadam must be replaced for a part of the old material, it is often possible to remove the material, screen it and replace a coarse part of it.

There are often cables embedded at the side of the track and they are sometimes in tubes or hoses. They should nowadays normally be at a depth of one meter but they are often closer to the surface in old roadbeds. Usually, ordinary bucket excavators are used to remove the excess material and, in order not to damage the cables, a man with a manual worktool, for example a pick axe, must aid in the excavation. This operation is costly and time consuming and still, the risk of damaging the cables is not eliminated.

OBJECT OF INVENTION AND BRIEF DESCRIPTION OF THE INVENTION

It is an object of the invention to provide a method of grading an existing railroad bed in which cables and/or tubes are embedded outside of the rails, which method is safer and faster and more economic than usually used methods. It is also an object o the invention to provide a laser measuring device for reading the profile of a railroad bed.

The method according to the invention is characterised in that, at intervals along the bed, one removes material by suction so that pits or transverse trenches are formed at each side of the track and, with a laser camera, one both reads the profile adjacent the pits and the positions of the embedded cables/tubes and saves this information, and then, by using the saved information, one controls a device for mechanically excavating material from the roadbed sides without damaging the embedded cables/tubes and grades the railroad bed.

The laser measuring device according to the invention comprises a rail car with a transverse guide beam and a carriage with a laser camera arranged to be movable along the guide beam, and the laser camera is directed downwards to read the distance to the ground and a computer is coupled to register the position of the carriage on the rail and the distance from the camera to the ground.

The invention is defined by the claims.

DESCRIPTION OF THE ILLUSTRATED EXAMPLE OF A LASER MEASURING DEVICE ACCORDING TO THE INVENTION

AND OF THE ILLUSTRATED EXCAVATING MACHINE, BOTH SUITABLE FOR THE INVENTIVE METHOD OF GRADING AN EXISTING RAILROAD BED IN WHICH CABLES AND/OR TUBES ARE EMBEDDED OUTSIDE OF THE RAILS

Figure 1:
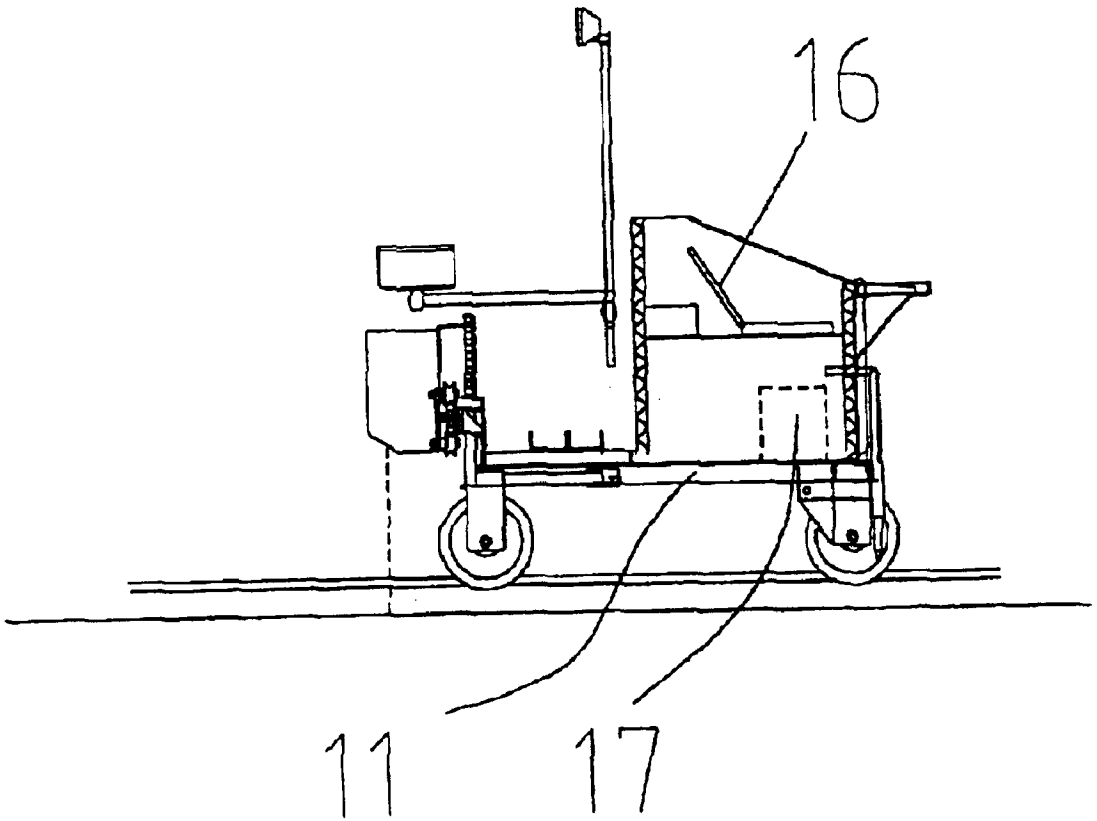
FIG. 1 shows in a lateral view a measuring rail car.
Figure 2:
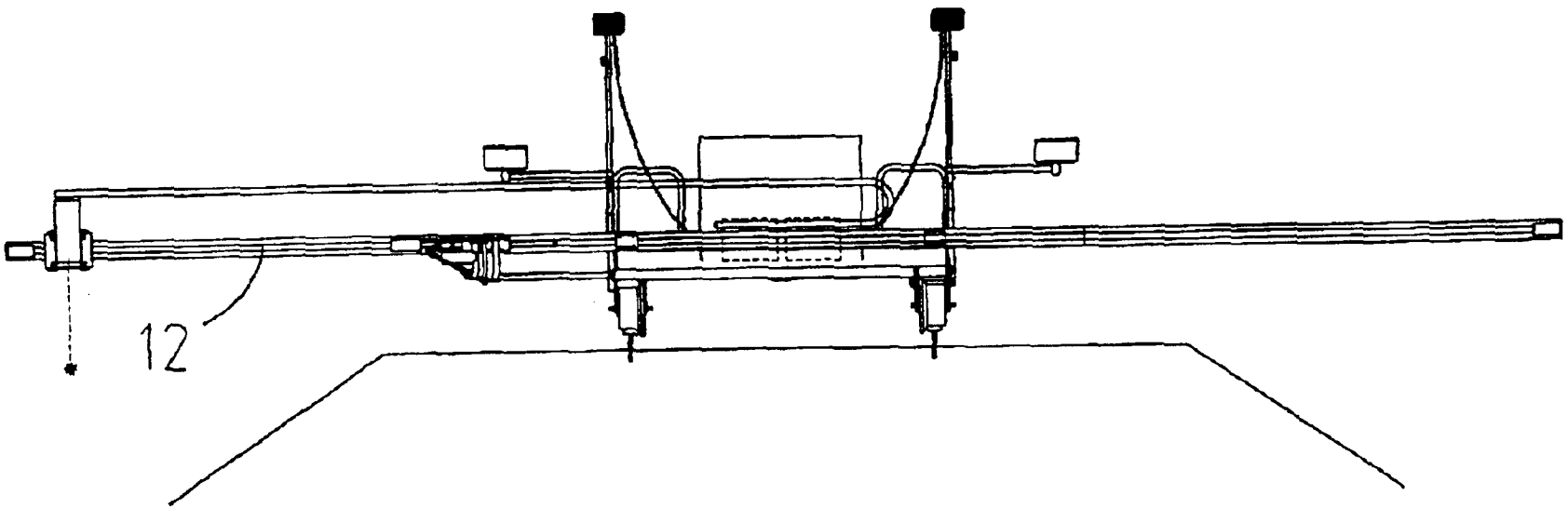
FIG. 2 shows the rail car of FIG. 1 in a front view.
Figure 3:
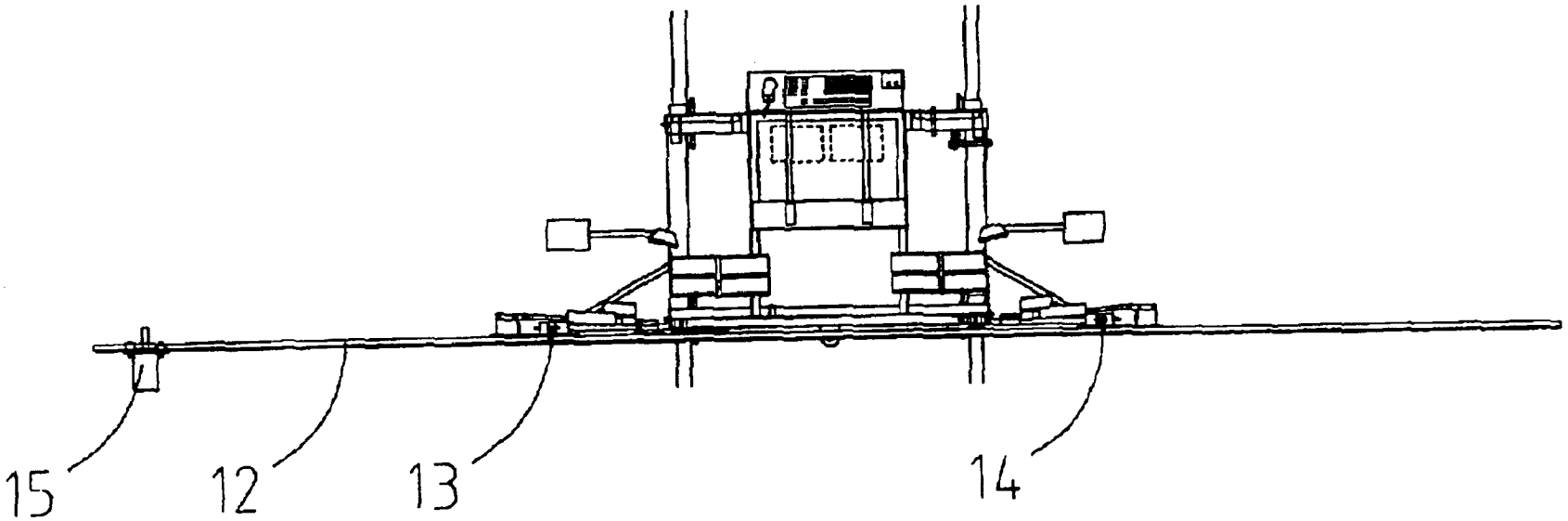
FIG. 3 shows the rail car of FIG. 1 in an elevation view

The device, a measuring rail car, shown in FIGS. 1–3 comprises a trolley or rail car 11 that has a transverse guide beam 12. The guide beam 12 is articulated and has two joints 13, 14 in which its two outer parts can be folded towards the rail car into a transport position in parallel with the car. The guide beam has a rack, and a carriage 15 with a laser camera is carried by the guide beam and is movable along the guide beam by means of a low voltage electric motor. The motor has a pulse transmitter and the position of the carriage on the guide beam is stored in a computer 16. The guide beam has a transmitter for indicating a home position for the carriage and each time the carriage passes this home transmitter, the computer adjusts the position given by the pulse transmitter to the actual position on the guide beam. Thus, there is an arrangement for accurately defining and storing the position of the laser camera on the roadbed. An ordinary car accumulator 17 is the common power source for the carriage and for the rail car. There is also an arrangement for accurately defining and storing the position of the railcar along the track.

The laser camera of the carriage 15 is directed downwards and it reads the distance to the ground or to the object that the laser beam meets, and this distance is registered and stored in the computer together with the position of the carriage on the guide beam; that is, the position of the camera on the guide beam. The laser camera is of any conventional kind available on the market.

Figure 4:
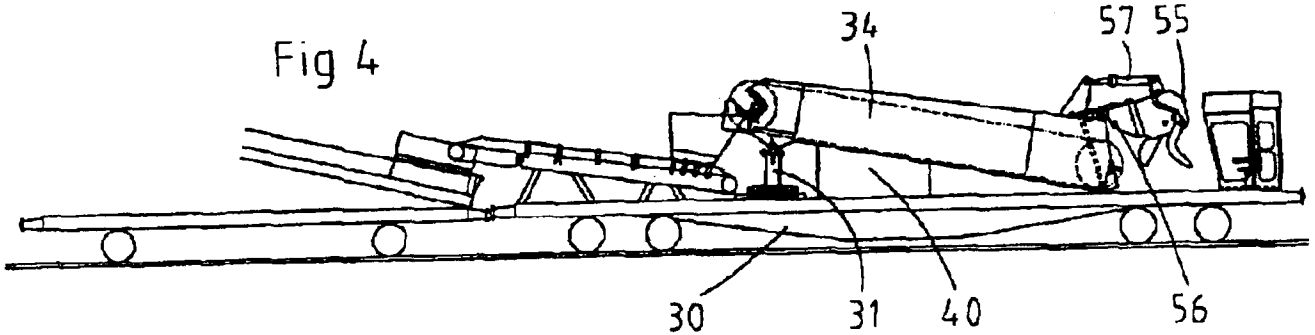
FIG. 4 shows in a lateral view a machine for excavation in its transport position.
Figure 5:
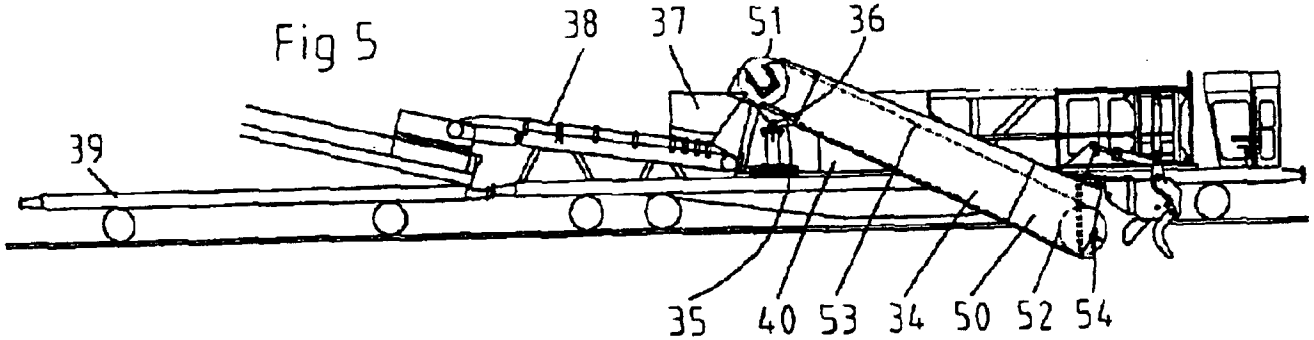
FIG. 5 corresponds to FIG. 4 but shows the machine in its position for excavation.
Figure 6:
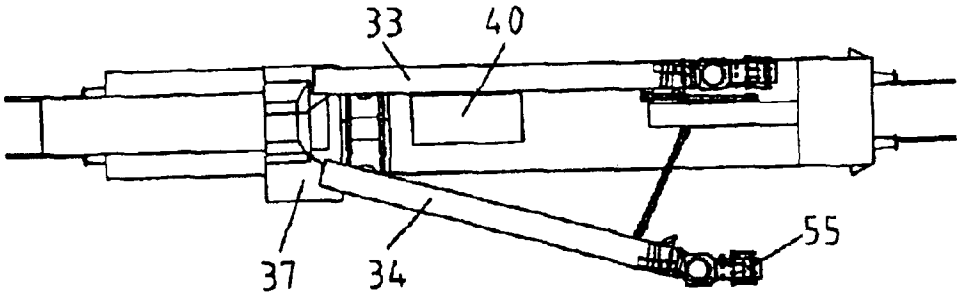
FIG. 6 is an elevation view of the machine shown in FIGS. 4 and 5.
Figures 4, 5, 6:
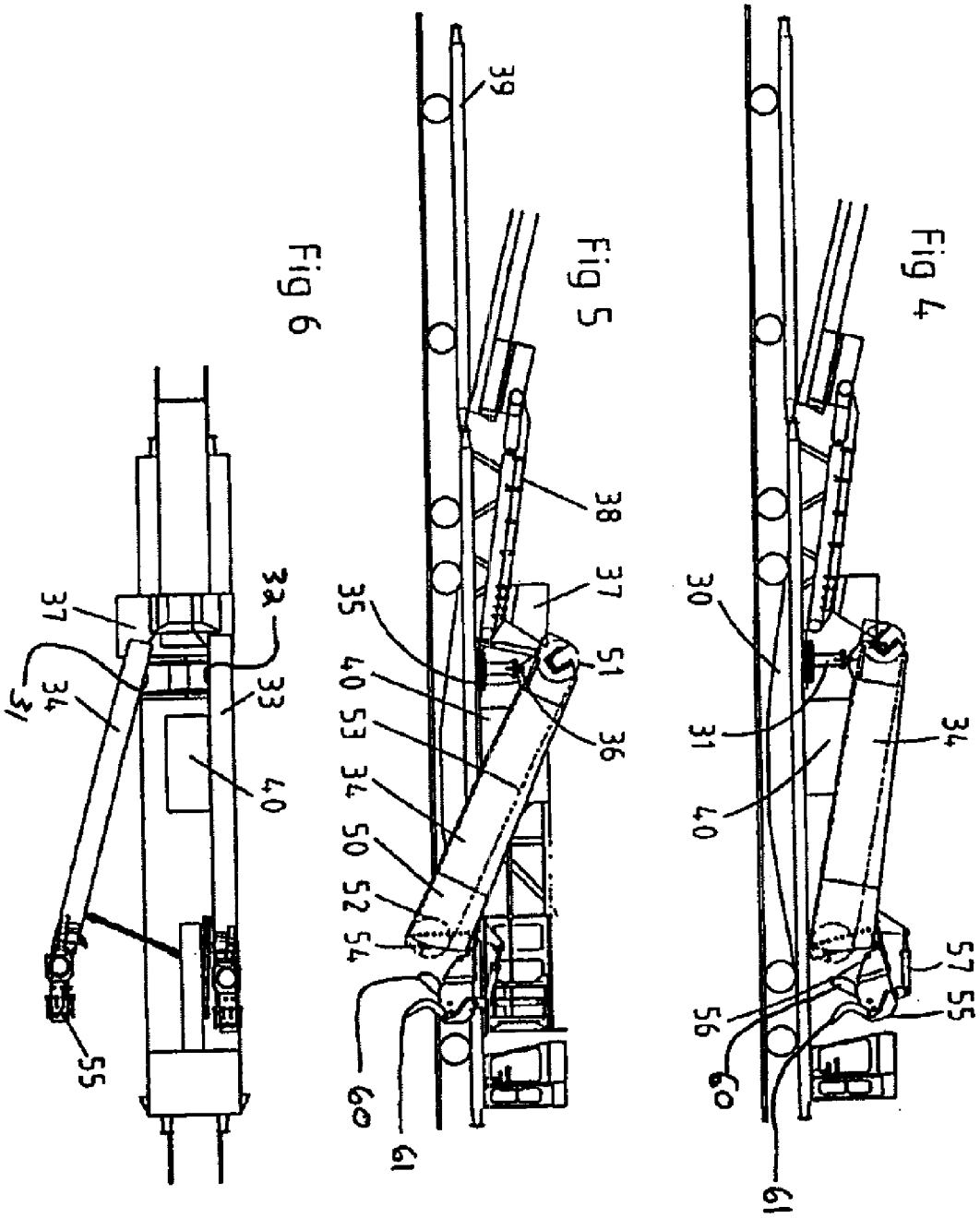

The FIGS. 4–6 show a machine for excavating excess material from a railroad bed on both sides of the track. It comprises a bogie car 30 that has two pillars 31, 32 each of which carries universally pivotable a scraper conveyor 33, 34. The upper portion 35 of the pillar 31 is turnable in the pillar and it has a transverse axle 36 that tiltably carries the scraper conveyor 34. The other scraper conveyor 33 is mounted in the same way on the pillar 32. The scraper conveyors are shown in their positions for transport in FIG. 4. In FIG. 5, the conveyor 34 is shown in its position for excavating. In FIG. 6, the conveyor 34 is shown in its position for excavating and the conveyor 33 is shown in its position for transport. The upper ends of the conveyors empty into a chute 37 that leads to another conveyor 38 and the conveyor 38 empties in its turn into a conveyor on a trailing goods wagon 39. In this way, in a set of trailing goods wagons, the rearmost wagon is first loaded and then the next to the last one and so on. The rearmost wagons can be pulled away, emptied and returned while the machine continuously excavates moving towards and loading the rearmost of the remaining wagons. On the bogie wagon 30, there is the driver's cabin and a power source in the form of a diesel engine 40. The power system can be a hydraulic system in which a main hydraulic pump is coupled to the diesel engine.

The scraper conveyors 33, 34 are identical and only the scraper conveyor 34 will be described in more detail. It has a chute 50 with two wheels 51, 52 on which there is an endless band or endless chains 53. The chains 53 have scrapers or buckets 54, only one of which is indicated. The wheel 51 drives the chains 53 so that the scrapers 54 scrape the material up along the bottom of the chute 50 and down into the chute 37.

The scraper conveyor 34 is shown having a head 55 with spurs 60, 61 arranged to loosen the ground and to indicate when they meet stones too big for the scraper conveyor. The head 55 is mounted to an axle 56, and an hydraulic cylinder 57 provides swinging movement to the axle 56.

The scraper conveyors can for example have a width of between 0.5 and 1 meter and usually, the entire train has to do more than one run to cover the entire sides of the roadbed. One operator controls the left scraper conveyor and another operator controls the right one. A machine of this kind may excavate 200 cubic meters of material an hour.

DETAILED DESCRIPTION OF THE INVENTIVE METHOD

The method according to the invention is carried out in three or four main steps.

Step 1:

In appropriate intervals, usually in intervals of between 15 and 30 meters, one makes pits or transverse trenches in the railroad bed at the sides of the track by means of a vacuum excavator. The trenches or pits are made so deep that possible tubes or cables are freed. With this method of sucking away the material, there is no risk of damaging the tubes or cables.

Step 2:

The rail car 11 shown in FIGS. 1–3 is moved Into a position in which the guide beam 12 is near two trenches or pits made in step 1; suitably the car is stopped a meter or half a meter in front of them. In this position, the profile of the entire width of the roadbed is scanned. This scanning is carried out automatically with the laser carriage 15 moving at a constant velocity along the guide beam 12. Preferably, the scanning is repeated and stored in the computer that alarms should the two scannings differ too much. Then, the rail car 11 is moved forward until the guide beam 12 is over the trenches or pits. Another scanning is carried out, but this time, the laser carriage 15 is manually controlled and stopped when the laser point reaches a cable or tube. The operator writes into the computer which tube he indicated and then he moves the carriage to next cable or tube. If the laser is of the kind that does not produce a visible beam, an additional visible beam can be used which is used only for the guidance. By indicating the tubes or cables manually in the computer, their individual positions are controlled and stored, which is advantageous since they may be twisted between two trenches/pits. The position of the railcar along the rails is also stored for each scanning. In this step, the operator also writes into the computer the condition of the material in the trenches/pits.

With the information stored in the computer, the profile of the roadbed and the positions of the various tubes and cables are analysed, and it is decided for each portion of the roadbed how much of the material that must be removed and if it can be done without risk of damaging the cables or tubes. It is also decided whether or not material has to be removed, screened and replaced in order to improve the draining capability of the roadbed. If the cables or tubes can remain in their positions and no cables or tubes need be added, step 3 can be omitted.

Step 3:

If the cables or tubes must be lowered, as much as possible of the material above them are removed preferably by being ploughed aside, and the cables and tubes are freed along their entire length by the same suction excavator as used in step 1. Then, they are lowered by a conventional cable-laying plough together with any additional cables or tubes.

Step 4:

Mechanical excavation is carried out as a result of the analysis carried out in step 2. Preferably, but not necessarily, a railbound excavating machine as described with reference to FIGS. 4–6 is used. New or screened old material is replaced if necessary. Finally, the roadbed sides are graded. This grading can be carried out together with the excavation or together with the possible replacement of material or it can be carried out as a separate last step.

Comments:

The two first steps are comparatively not very costly and as a result of the analysis in step 2, the further steps can be decided as to their necessity and acuteness. The steps 1 and 2 can be carried out one year and the following more expensive steps can be carried out the following year or even some years later. The method provides a possibility to make a priority between various railway lines in a way that is not very costly. The analysis in step 2 makes it possible to provide very accurate documents as basis for tenders for the steps 3 and 4.

What is claimed is:

1. A method of grading an existing railroad bed in which cables or tubes are embedded outside of the track, the steps of said method comprising:

removing material at intervals along the railroad bed by vacuum excavation to form pits or transverse trenches at each side of the track to free the cables or tubes;

reading the original railroad bed profile near the pits or trenches with a laser camera, and reading the positions in the railroad bed of the freed cables or tubes in the pits or trenches with the laser camera;

saving the information read by the laser camera; and using the saved information for controlling a device (33, 34) for mechanically excavating material from the sides of the railroad bed without damaging the freed cables or tubes and grading the railroad bed.

2. The method according to claim 1, further including the step of ploughing down the cables or tubes to a predetermined depth before excavating material and grading the railroad bed if the embedded cables or tubes are determined to be within a predetermined distance below the upper surface of the railroad bed.

3. The method according to claim 2, further including the steps of mechanically removing material above the cables or tubes, and thereafter freeing the cables or tubes by the step of vacuum excavation prior to performing the step of ploughing down the cables or tubes.

4. The method according to claim 1, further including the steps of continuously evacuating the material while moving an excavating machine (30) along the track, and conveying the excavated material onto at least one trailing wagon (39).

5. A laser measuring device for reading the profile of a railroad bed, said device comprising a rail car (11) having a transverse guide beam (12) and a carriage (15) having a laser camera movably mounted along the guide beam, said laser camera being oriented in a downward direction for reading the distance to the ground, and a computer (16) for registering the position of the carriage on the guide beam and the distance between the laser camera and the ground.

6. The laser measuring device according to claim 5, wherein said guide beam (12) is foldable along the rail car (11), at both sides of the rail car, into a position for transport.

7. The method according to claim 2, further including the steps of continuously evacuating the material while moving an excavating machine (30) along the track, and conveying the excavated material onto at least one trailing wagon (39).

8. The method according to claim 3, further including the steps of continuously evacuating the material while moving an excavating machine (30) along the track, and conveying the excavated material onto at least one trailing wagon (39).

* * * * *

UNITED STATES PATENT AND TRADEMARK OFFICE

CERTIFICATE OF CORRECTION

PATENT NO. : 6,897,967 B2
DATED : May 24, 2005
INVENTOR(S) : Dan Nilsson

It is certified that error appears in the above-identified patent and that said Letters Patent is hereby corrected as shown below:

Delete Drawing Sheet 4 and substitute therefor the Drawing Sheet 4 consisting of Fig. 4, 5, 6 as shown on the attached page.

Signed and Sealed this

Twenty-sixth Day of July, 2005

JON W. DUDAS
*Director of the United States Patent and Trademark Office*

30
31
40
34
57
55
56
60
61

39
38
37
51
36
35
40
53
34
50
52
54
60
61

37
34
31
33a
33
40
55